United States Patent [19]

Wenzlick et al.

[11] Patent Number: 4,797,968

[45] Date of Patent: Jan. 17, 1989

[54] VACUUM CLEANER HEAD PROTECTOR AND DUSTER

[76] Inventors: Judy I. Wenzlick, 1516 W. St. John Rd., Phoenix, Ariz. 85023; Judith E. Wenzlick, 6751 W. Topeka, Glendale, Ariz. 85308

[21] Appl. No.: 192,602

[22] Filed: May 11, 1988

[51] Int. Cl.[4] ..... A47L 9/00

[52] U.S. Cl. ..... 15/246; 15/45; 15/325

[58] Field of Search ..... 15/246, 45, 325

[56] References Cited

U.S. PATENT DOCUMENTS

| | | | |
|---|---|---|---|
| 1,091,383 | 3/1914 | Oblosser | 15/325 X |
| 1,570,482 | 1/1926 | Hale | 15/45 |
| 1,918,135 | 7/1933 | Resch | 15/45 X |
| 1,952,014 | 3/1934 | Kirby | 15/325 X |
| 1,978,579 | 10/1934 | Hooks | 15/403 |
| 3,715,772 | 2/1973 | Downing et al. | 15/49 |
| 4,638,523 | 1/1987 | Todd | 15/246 |

FOREIGN PATENT DOCUMENTS

| | | | |
|---|---|---|---|
| 2154128A | 9/1985 | United Kingdom | 15/325 |

*Primary Examiner*—Chris K. Moore

*Attorney, Agent, or Firm*—Jordan M. Meschkow; Don J. Flickinger

[57] ABSTRACT

A protective apparatus for use on the head of a vacuum cleaner, carpet sweeper, or the like, includes a strip of fabric having a length sufficient to extend along the front and sides of the head. First and second brushes are removably coupled to the strip of fabric at locations which are adjacent the first and second sides of the head when the strip is secured to the periphery of the head. The strip is detachably secured to the periphery of the head as for example by means of loop and hook fasteners.

17 Claims, 2 Drawing Sheets

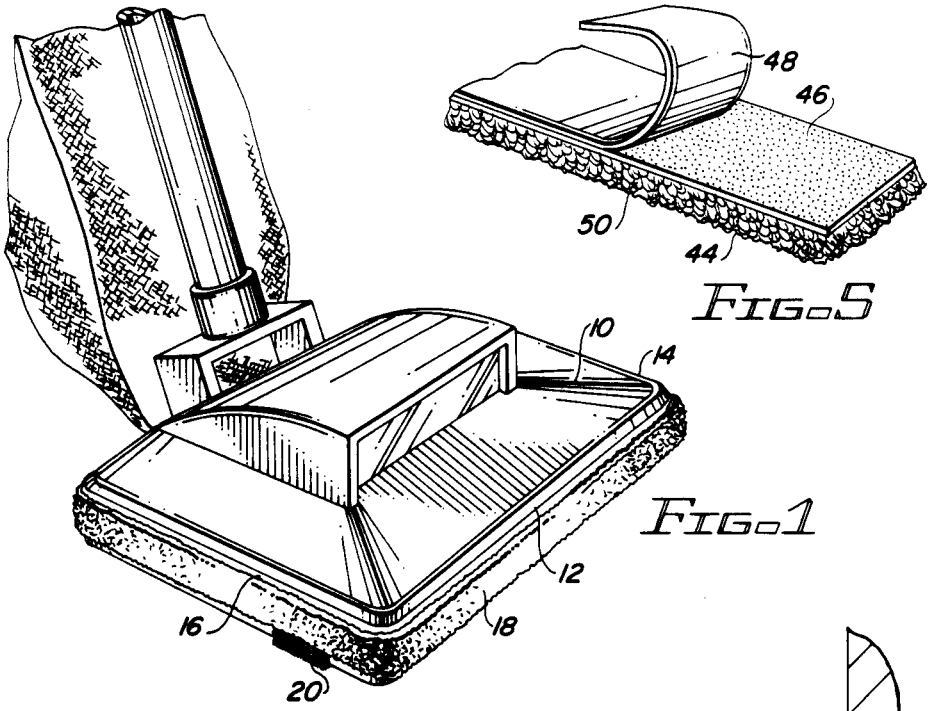
FIG. 1
FIG. 5
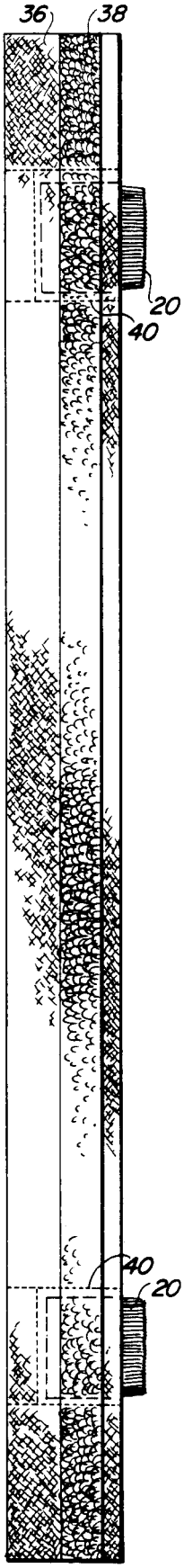
FIG. 3
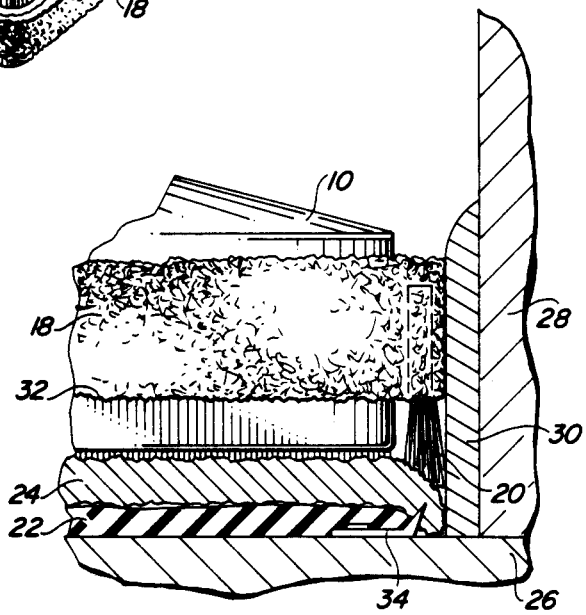
FIG. 2
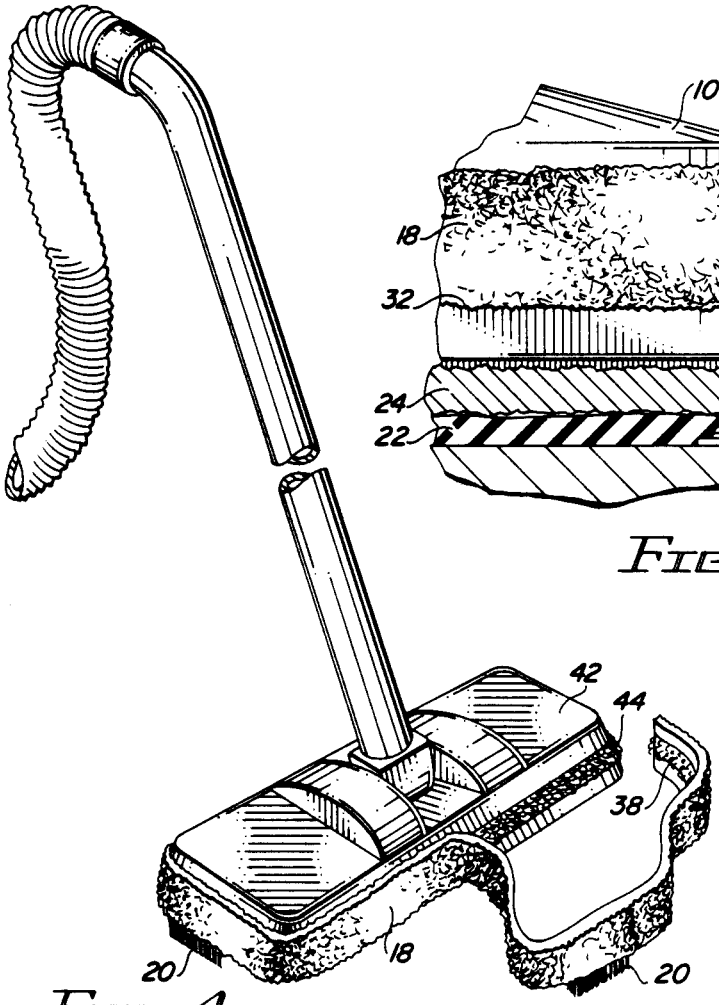
FIG. 4

VACUUM CLEANER HEAD PROTECTOR AND DUSTER

BACKGROUND OF THE INVENTION

This invention relates generally to a vacuum cleaner head protector, and more particularly to a vacuum cleaner head protector which also dusts baseboards and the bottom of furniture and sweeps dirt and debris from the region immediately adjacent the baseboard, furniture, etc.

It is known to provide floor and carpet cleaning appliances such as canister or upright vacuum cleaners, carpet sweepers and/or polishers with a shock cushioning or buffer band around the periphery of the working head to protect baseboards, furniture, doors, etc. from damage. Often times, such buffer bands take the form of rubber or soft plastic strips. Unfortunately, such bands often mark or scuff the bottom of the baseboard, furniture, etc.

Other forms of protectors or guards have been developed which do not suffer from the disadvantages associated with rubber or plastic bands. For example, United Kingdom Patent Application GB No. 2 154 128A discloses a vacuum cleaner nozzle housing which has a textile layer covering its periphery as a buffer. This layer is defined as a band of woven or knitted fabric with a short stiff pile. U.S. Pat. No. 1,570,482 discloses a furniture guard for carpet sweepers which comprises a strip of heavy fabric preferably "Brussels carpet".

While these known devices are useful to some degree for carrying out their protective functions, they are difficult to deploy and do not significantly enhance the cleaning function.

SUMMARY OF THE INVENTION

It is an object of the present invention to provide an improved protective apparatus for use on a vacuum cleaner head or the like.

It is a further object of the present invention to provide an improved protective apparatus for use on a vacuum cleaner head which also dusts baseboards, furniture, etc.

It is a still further object of the present invention to provide an improved protective apparatus for use on a vacuum cleaner head which also sweeps the region adjacent baseboards, furniture, etc.

A still further object of the present invention is to provide an improved protective apparatus for use on a vacuum cleaner head or the like which is simple to attach and use.

Yet another object of the present invention is to provide an improved protective apparatus for use on a vacuum cleaner head or the like which is detachable and may be washed.

According to a broad aspect of the invention there is provided a protective apparatus for use on the head of a vacuum cleaner, carpet sweeper, or the like. The head has a periphery including at least a front and first and second sides. The protective apparatus includes a strip of fabric having upper and lower edges and first and second major surfaces, the strip having a length sufficient to extend along the periphery of the head. First means are provided for detachably securing the strip of fabric to the periphery of the head. At least one brush is removably coupled to the strip of fabric at a location which is adjacent one of the sides of the head when the strip is secured to the periphery. A second brush may be coupled to the fabric so as to reside adjacent the second side.

BRIEF DESCRIPTION OF THE DRAWINGS

The above and other objects, features and advantages of the present invention will be more clearly understood from the following detailed description taken in conjunction with the drawings in which:

FIG. 1 is a perspective view of an upright vacuum cleaner head having the inventive protection apparatus deployed around its periphery;

FIG. 2 illustrates the use of the inventive protective apparatus on an area of carpet adjacent the baseboard;

FIG. 3 is a plan view of the inventive protective strip;

FIG. 4 illustrates the deployment of the inventive protective apparatus around the periphery of the head of a canister-type vacuum cleaner;

FIG. 5 shows a strip of attaching material prior to attachment to the periphery of the vacuum cleaner head shown in FIG. 4;

BRIEF DESCRIPTION OF THE PREFERRED EMBODIMENT

Figure 6:
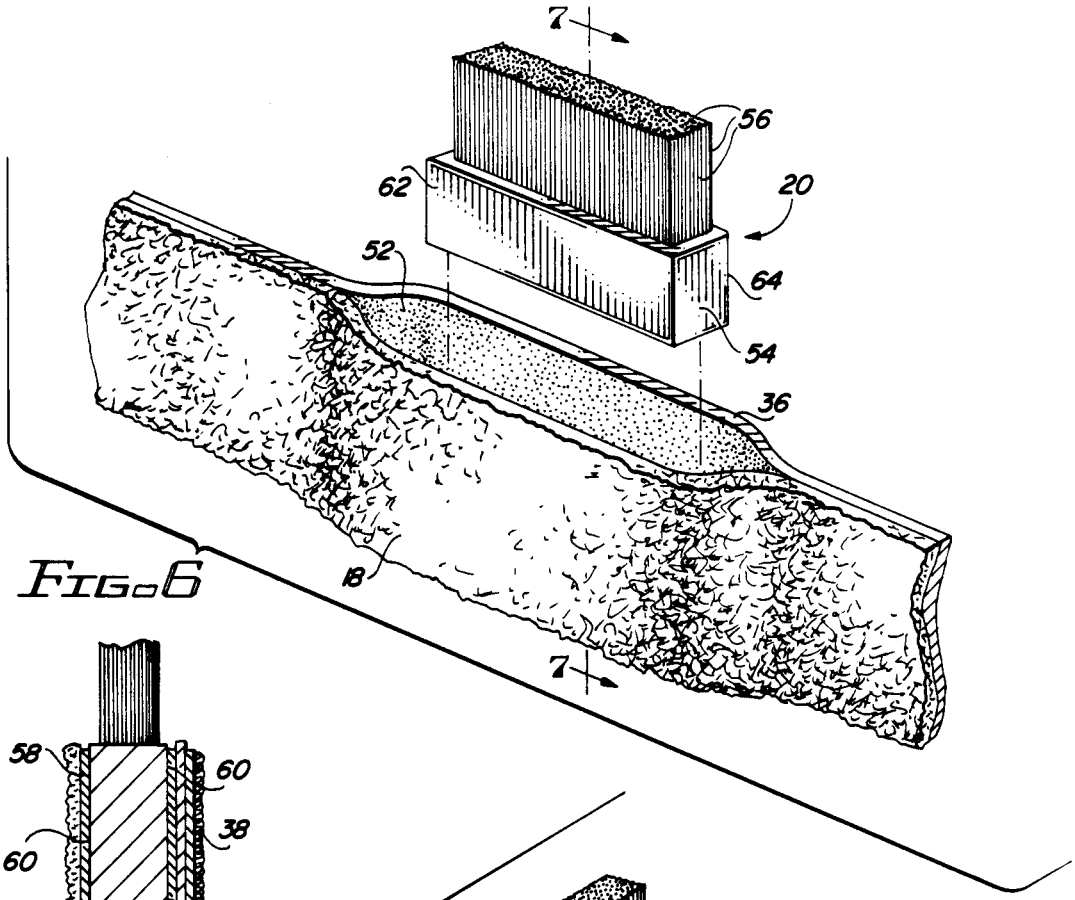
FIG. 6 illustrates in more detail a first technique for securing brushes to the protective strip shown in FIGS. 1 and 4.

Referring to FIG. 1, there is shown the head 10 of an upright vacuum cleaner. As can be seen, head 10 has a periphery which includes in part a front 12 and first and second sides 14 and 16. The strip of fabric 18 (e.g. a sheepskin-type material) having a width of approximately two to three inches is detachably secured to the periphery of head 10 and extends around front 12 and sides 14 and 16. Extending downward from strip 18 adjacent sides 14 and 16 are the bristles of brushes 20 only one of which is shown which are detachably secured to strip 18 in a manner to be described below.

Referring to FIG. 2, there is shown that portion of a typical pad 22 and carpet 24 which resides over floor 26 adjacent wall 28. As can be seen, a baseboard 30 is fixed to the lower portion of wall 28 in the well known manner. Pad 22 and carpet 24 are held in place by nailboard 34 which is secured to floor 26 in the well known manner.

When vacuuming that portion of carpet 24 immediately adjacent baseboard 30, the prior art vacuum cleaners would result in damage or marking of the baseboard should contact occur between the baseboard and head 10. Inventive protective apparatus prevents this in that protective strip 18 contacts the baseboard not only protecting it from damage, but also dusting it.

The bristles of brush 20 extend far below the lower edge 32 of strip 18 and below the cleaning plane of head 10. In this manner, the bristles of brush 20 extend downward into the region between carpet 24 and baseboard 30 to remove and/or loosen dirt and debris which has accumulated there.

FIG. 3 is a plan view of the rear of protective strip 18. A stiff fabric backing 36 may be secured to fabric 18 such as by sewing. Secured to backing material 36 is a strip 38 of a fabric-type fastener commonly referred to as velcro. That is, fastening strip 38 is a flexible material having protruding therefrom a plurality of flexible loops. Brushes 20 are removably secured in pockets 40 in a matter to be more fully described.

Referring now to FIG. 4, there is shown the working head 42 of a cannister-type vacuum cleaner. Secured to the periphery thereof is a velcro strip 44 of the type shown in FIG. 5. That is, the strip has a backing 46 on which there is provided a pressure sensitive adhesive. A protective sheet 48 protects the adhesive until the strip is to be secured. Thus, by merely peeling away 48, backing 46 may be secured to the periphery of head 42. In this case, a plurality of flexible hooks 50 protrude from backing 46 and matingly and detachably receive the flexible loops protruding from strip 38. Obviously, fastening strip 38 may be provided with the plurality of hooks if fastening strip 44 is of the type which includes a plurality of loops. In this manner, protective strip 18 is secured to the periphery of head 42.

Figure 7:
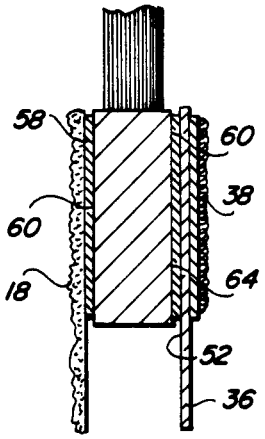
FIG. 7 is a cross-sectional view taken along line 7—7 in FIG. 6.

FIGS. 6–9 illustrate in more detail how the brushes 20 may be secured to protective strip 18. Referring first to FIGS. 6 and 7, it can be seen that strip 18 and backing material 36 having velcro strip 38 secured thereto form a pocket 52 for receiving brush 20. Brush 20 includes a housing 54 and a plurality of bristles 56 each having a first end fixidly coupled in housing 54 and each having a second free end. On the inner surface of strip 18 is a region 58 which has provided thereon a pressure sensitive adhesive. Similarly, on the inner surface of backing material 36 is a region 60 on which is provided a pressure sensitive adhesive. The pressure sensitive adhesive is brought to bear against the sides 62 and 64 of housing 54 so as to secure brush 20 in place.

Figure 8:
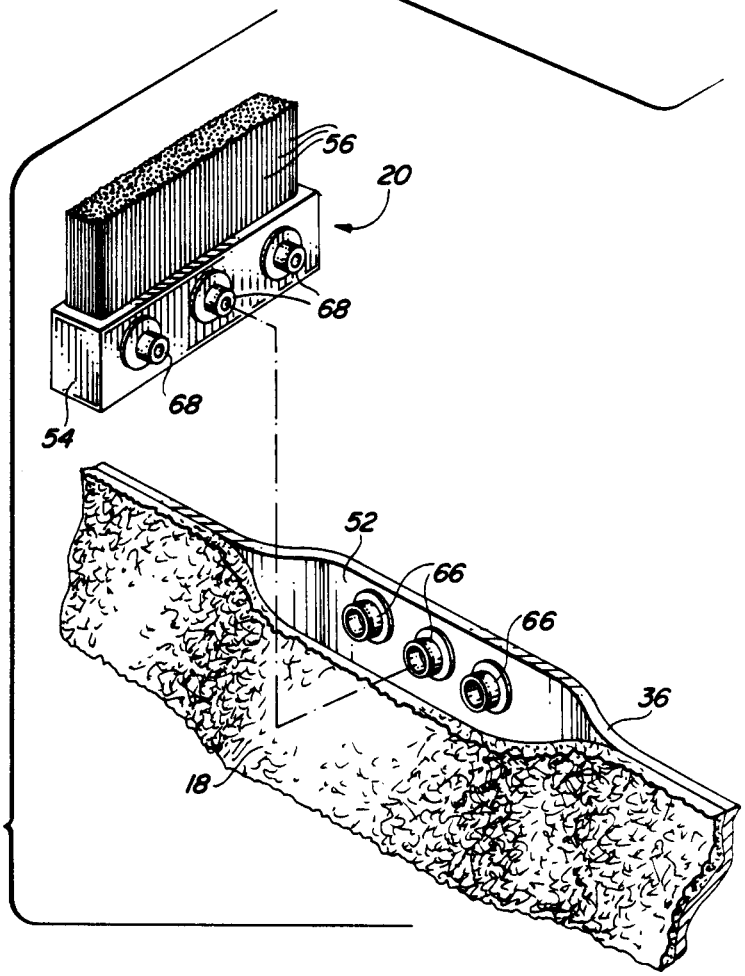
FIG. 8 illustrates an alternative technique of securing brushes to the protective apparatus.

FIGS. 8 and 9 illustrate an alternative method of securing brush 20 within pocket 52. That is, one or more fastening members 66 such as for example, the female element of a conventional snap are secured to backing material 36. Housing 54 of brush 20 (shown reversed in FIG. 9 for clarity) has secured thereto a plurality of male fastening members 68 which are matingly received within female members 66. In this manner, the brushes 20 are secured within pockets 52; however, they may be removed at will.

Thus, there has been described a protective apparatus which may be secured to the working heads of vacuum cleaners, carpet sweepers, etc. for protecting baseboards, furniture, doors and the like. The strip not only protects the baseboards etc. from damage, but also dusts and cleans them. Brushes are provided within the apparatus to loosen dirt and debris which has been accumulated in the region between the carpet and the baseboard. Both the protective apparatus and the brushes therein may be removed for cleaning or replacement.

The above description is given by way of example only. Changes in form and details may be made by one skilled in the art without departing from the scope of the invention as defined by the appended claims.

We claim:

1. A protective apparatus for use on the head of a vacuum cleaner, carpet sweeper, and the like, said head having a periphery including at least a front and first and second sides, said apparatus comprising:

a strip of fabric having upper and lower edges and first and second major surfaces, said strip having a length sufficient to extend along said periphery;

first means for detachably securing said strip of fabric to said periphery of said head; and at least one brush removably coupled to said strip of fabric at a location which is adjacent at least one of said first and second sides when said strip is secured to said periphery.

2. An apparatus according to claim 1 further comprising at least a second brush removably coupled to said strip of fabric at a location which is adjacent to the other of said first and second sides when said strip is secured to said periphery.

3. An apparatus according to claim 2 wherein said first and second brushes each comprise:

a housing portion; and a plurality of flexible bristles each having a first end fixed in said housing and a free second end.

4. An apparatus according to claim 3 wherein said second edge is normally lower than said first edge when said strip is secured to said periphery of said head and wherein said free ends of said bristles extend below said second edge.

5. An apparatus according to claim 3 further comprising a stiffening material coupled to the first major surface of said strip of material along at least a portion of its length.

6. An apparatus according to claim 5 wherein said stiffening material is a stiff fabric backing.

7. An apparatus according to claim 6 wherein the housing portion of each of said first and second brushes is removably secured to said backing material.

8. An apparatus according to claim 7 further comprising a pressure sensitive adhesive region on said backing material for engaging said housing portion of each of said first and second brushes.

9. An apparatus according to claim 7 further comprising:

a first fastening member fixedly coupled to said housing; and a second fastening member fixedly coupled to said backing material for matingly engaging said first fastening member to detachably secure said housing to said backing material.

10. An apparatus according to claim 6 wherein the housing portion of each of said first and second brushes is removably secured to said first major surface.

11. An apparatus according to claim 10 further comprising a pressure sensitive adhesive region on said first major surface for engaging said housing portion of each of said first and second brushes.

12. An apparatus according to claim 10 further comprising:

a first fastening member fixedly coupled to said housing; and a second fastening member fixedly coupled to said first major surface for matingly engaging said first fastening member to detachably secure said housing to said first major surface.

13. An apparatus according to claim 1 wherein said first means comprises:

first fastening means coupled to said periphery; and second fastening means coupled to said first major surface for detachably engaging said first fastening means.

14. An apparatus according to claim 13 further comprising a stiff backing material coupled between said first major surface and said second fastening means.

15. An apparatus according to claim 14 wherein said first fastening means is of the type which has a fabric base and a plurality of hooks extending therefrom.

16. An apparatus according to claim 15 wherein said second fastening means is of the type which has a fabric base and a plurality of loops extending therefrom.

17. An apparatus according to claim 1 wherein said strip of fabric has a deep pile extending from said second major surface suitable for dusting.

* * * * *